US006513745B1

(12) United States Patent
Suter et al.

(10) Patent No.: US 6,513,745 B1
(45) Date of Patent: Feb. 4, 2003

(54) CLOSURE AND DISCHARGE DEVICE FOR A WINDING OF AN ELONGATED ELEMENT

(75) Inventors: Hans Suter, Seon (CH); Gilbert Beaud, Lausanne (CH); Franz Jermann, Romanel-sur-Morges (CH)

(73) Assignee: Nextrom Holding SA, Ecublens (CH)

( * ) Notice: Subject to any disclaimer, the term of this patent is extended or adjusted under 35 U.S.C. 154(b) by 0 days.

(21) Appl. No.: 09/807,600

(22) PCT Filed: Oct. 13, 1999

(86) PCT No.: PCT/CH99/00483

§ 371 (c)(1),
(2), (4) Date: May 30, 2001

(87) PCT Pub. No.: WO00/23369

PCT Pub. Date: Apr. 27, 2000

(30) Foreign Application Priority Data

Oct. 16, 1998 (EP) ..... 98811031

(51) Int. Cl.[7] ..... B21C 47/24; B65H 55/00; B65B 27/06

(52) U.S. Cl. ..... 242/362.2; 100/5; 100/12; 242/172; 242/475.7; 242/580

(58) Field of Search ..... 242/475.7, 362.2, 242/362.3, 363, 172, 580; 53/528, 589; 100/5, 12, 916

(56) References Cited

U.S. PATENT DOCUMENTS 1,300,974 A * 4/1919 Johannsen ..... 242/580
1,538,136 A * 5/1925 Prentiss et al. ..... 242/172
2,548,248 A * 4/1951 Wiebe ..... 242/580
3,861,615 A * 1/1975 Kinnicutt, Jr. ..... 242/363
4,301,720 A * 11/1981 Elineau ..... 100/12
4,921,180 A 5/1990 Greckesch et al.
5,088,394 A * 2/1992 Bertrand et al. ..... 100/12
5,540,142 A * 7/1996 Mieleszuk et al. ..... 100/12
6,305,277 B1 * 10/2001 Witczak et al. ..... 100/12

FOREIGN PATENT DOCUMENTS

| | | | |
|---|---|---|---|
| DE | 41 42 262 A1 | | 1/1993 |
| EP | 0 992 447 A1 | | 4/2000 |
| JP | 62 264173 A | | 11/1987 |
| JP | 5-294318 A1 | * | 11/1993 |

* cited by examiner

*Primary Examiner*—Michael R. Mansen
(74) *Attorney, Agent, or Firm*—Oliff & Berridge, PLC

(57) ABSTRACT

The closure device is intended to hold the free end of an elongated element on a winding collected on a winding station during the operations of making ligatures on this winding. The device includes a support, capable of being set in rotation about a shaft coaxial with the winding, and two means of actuating bent arms, pressing portions of which are capable of clamping the last layer of the winding. This device makes it possible to automate the finishing operations of the winding. Furthermore it makes it possible to aid in discharging the finished winding from the winding station.

11 Claims, 2 Drawing Sheets

CLOSURE AND DISCHARGE DEVICE FOR A WINDING OF AN ELONGATED ELEMENT

BACKGROUND OF THE INVENTION

1. Field of the Invention

The present invention relates to a device allowing a winding, made up of an elongated element, collected in a plurality of layers of a plurality of wraps, on a winding station, to be closed and said winding to be discharged from the winding station.

2. Description of Related Art

Numerous elongated elements, such as, for example, tubes, profile sections of any shape, insulated or other cables, are obtained through a process of continuous extrusion of a synthetic material or any other manufacturing process. In view of their great length, these elements are coiled on a fixed double-flanged bobbin disposed on a coiling machine or otherwise on a false bobbin made up of two side plates and a central body forming a drum, at least one side plate being able to be disunited in order to extract from the central body the winding made up of the wound elongated element of a plurality of layers of a plurality of wraps. Such a device for making windings is described in particular in EP 0 992 447 A1.

Generally, when the required length of the elongated element is attained, the said element is cut slightly upstream from the place where the winding is produced and an operator must grasp the cut end and hold it so that it winds itself correctly on the last layer before a ligature can be made, manually or by automatic means, in order to hold the collected coil. This operation requires the presence of an operator, and is not without danger. In the case where the cut end is left free for a certain time without being held, the coil has the tendency to come undone, at least on its upper layer, which makes it less compact and less rigid once the ligatures are made.

SUMMARY OF THE INVENTION

After the winding has been bound, it is necessary to discharge it from the winding station where it has been collected. Separate means are generally provided for this purpose.

A first object of the invention is to propose a device allowing the cut end of an elongated element to be held, after having been cut, in such a way as to preserve the winding, and particularly its last layer, well collected.

A second object of the invention is to propose that the above device makes it possible for the finishing of the coil to be carried out automatically, or respectively without danger for the operator.

A third object of the invention is to allow the above device to be conceived in such a way as to permit discharge of a collected winding.

These different objects are achieved through a closure and discharge device. Variants or other embodiments are described in the dependent claims.

BRIEF DESCRIPTION OF THE DRAWINGS

A preferred embodiment of a device according to the invention is described below, whereby the description is to be considered with reference to the attached drawing comprising the figures where.

DETAILED DESCRIPTION OF THE PREFERRED EMBODIMENTS

Figure 1:
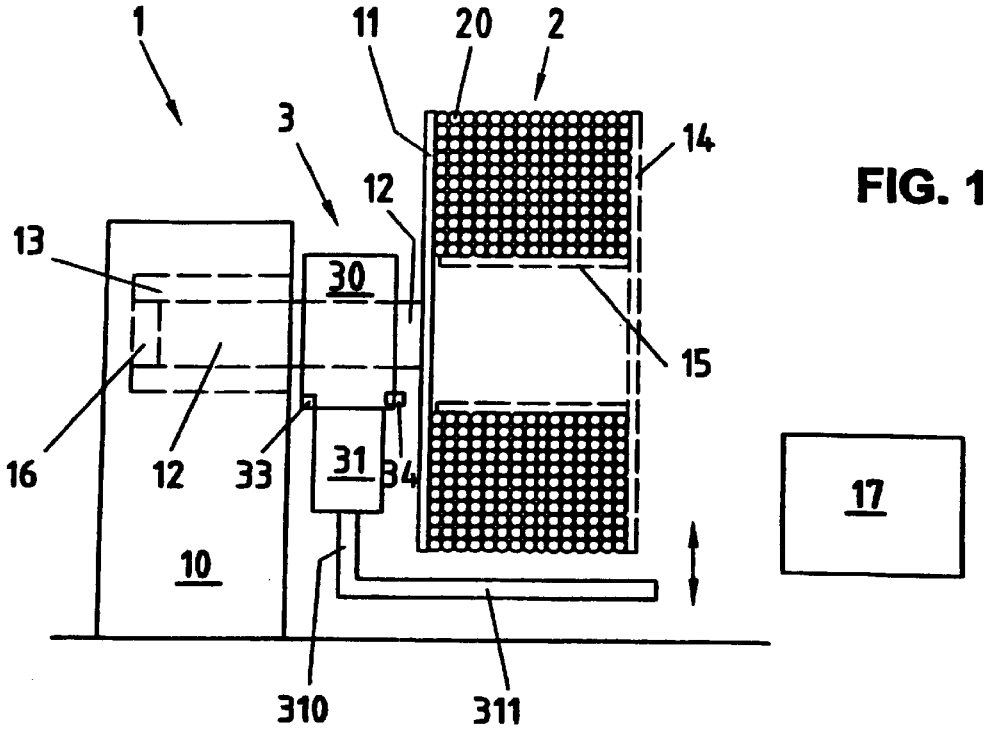
FIG. 1 is a partial view in transverse section of a device according to the invention connected to a winding station.

FIG. 1 shows a winding station 1 seen partially in section along a plane perpendicular to the longitudinal axis of the line of production of the elongated element 2. The winding station 1 comprises a frame 10 supporting a first side plate 11 intended to form a lateral support for a winding 20 in formation. This first side plate 11 is supported by a spindle 12 in a bearing 13 of the frame 10. The first side plate 11 can be set in free rotation in the bearing 13. A second side plate 14 and a false center 15, supported by another frame element, not shown in the figure, can be integral with the first side plate 11 in order to form a false bobbin permitting the elongated element 2 to be collected and gathered into a winding 20. Means of driving in rotation, not shown in the figure, allow the one and/or the other of the side plates 11, 14 to be driven in a way so as to wind the elongated element 2 on the false center 15.

Figure 2:
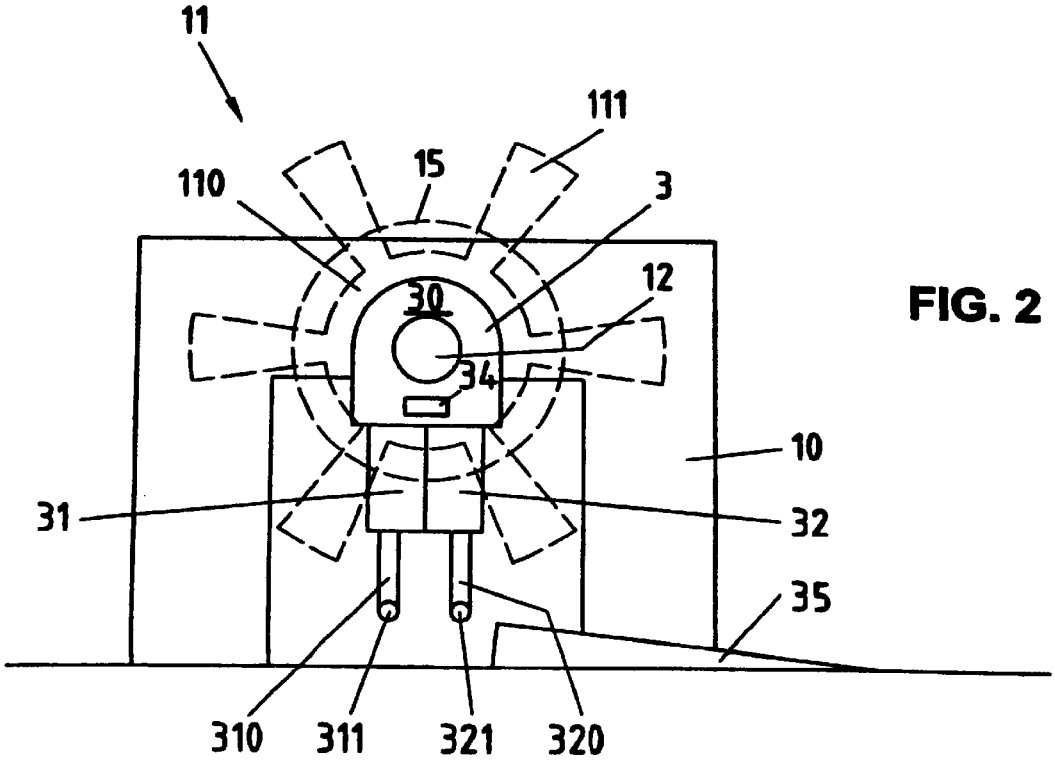
FIG. 2 is a lateral view of the device of FIG. 1, and FIGS. 3A to 3G represent a succession of stages showing the functioning of the device according to the invention.

As seen in FIG. 2, the first side plate 11, represented in broken lines, is made up of a central disk 110 on which a plurality of circular ring segments 111 are regularly disposed radially, a free space existing between two successive segments 111. The figure also shows in broken lines the diameter constituted by the false center 15 on which the winding 20 will be collected.

The closure device 3 is disposed coaxially on the spindle 12, between the frame 10 and the first side plate 11. In a general way, the device 3 turns freely on the spindle 12. The device 3 comprises a support portion 30, equipped with the bearing, itself permitting turning about the spindle 12, one side of the said support being equipped with two jacks 31, 32, each of them actuating a bent support arm 310, 320, each of the said bent arms being provided with a pressing portion 311, respectively 321 (see FIG. 2). As previously indicated, the device 3 can turn freely about the spindle 12; it possesses no own means of driving in rotation, but is, however, equipped with an indexing device of known technology, indicated schematically by 33. The indexing device 33 allows the device 3 to be locked in two angular positions relative to the frame 10, a first low position, as represented in FIGS. 1 and 2, where the bent arms 310 and 320 are disposed at the bottom of the winding 20, and a second high position, offset by 180° relative to the first position, where the bent arms are disposed at the top of the winding 20 (see FIG. 3C).

The two jacks 31 and 32 act upon the two bent support arms 310 and 320 to position them in a position of release, as represented in FIGS. 1 and 2 where the two pressing portions 311 and 321 are disengaged from the side plate 11 and from the winding 20, or a clamping position in which the two pressing portions 311 and 321 of the support arms 310 and 320 are engaged in a space separating two segments 111 and press the last layer making up the winding 20.

The two support arms 310 and 320 can preferably be actuated simultaneously as well as one independently of the other.

A detector of angular position 16 detects the relative angular position of the side plate with respect to the closure device 3, or respectively relative to the two bent arms 310 and 320, in such a way that a clamping of the pressing portions 311 and 321 can be ordered only when the said pressing portions are in a space separating two segments 111, this in order not to risk a damaging of the one and/or the other of the two bent arms 310, 320 as well as of a segment 111.

The device 3 can preferably be further equipped with another indexing device of known technology, indicated schematically by 34, able to lock the device 3 in a certain number of angular positions relative to the side plate 11, in which positions the said pressing portions 311 and 321 can engage themselves between two consecutive segments 111. When the locking 34 between the device 3 and the side plate 11 is engaged, a setting in rotation of the side plate 11 drives the rotation of the device 3.

The closure device 3 is controlled by a control unit 17, able to be adapted to the device itself, able to be integrated in the control unit of the winding station or able to be integrated in the control unit of the production line. The control unit 17 preferably comprises a microprocessor unit provided with a program allowing the operations of closure of the winding, which are going to be described below to be carried out.

Figure 3A:
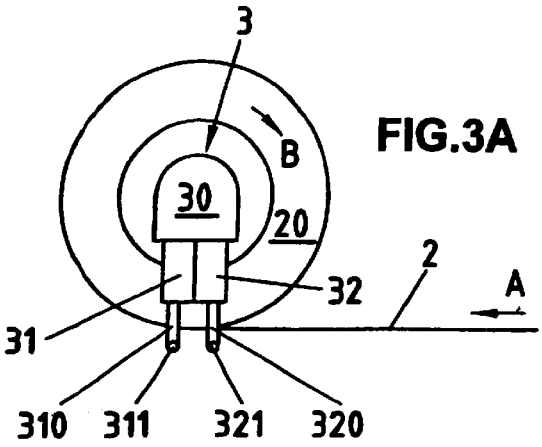

FIG. 3A and the following show schematically a winding 20 in the course of being made and the functioning of the closure and discharge device 3. In these figures only the elements strictly necessary for comprehension of the operations have been represented.

FIG. 3A shows an elongated element 2 in the course of production, by means of an extrusion or other process, the element 2 displacing itself as indicated by the arrow A, the winding 20 in the course of collection being in rotation, as indicated by the arrow B; the device 3 is locked in low position against the frame of the winding station, the two bent arms 310 and 320 being disengaged from the side plate and from the winding, and is unlocked relative to the side plate.

Figure 3B:
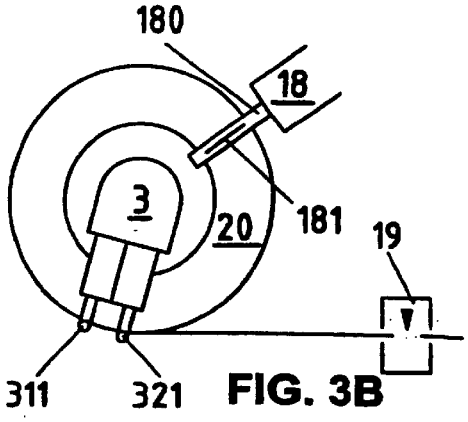

When the length of the element 2 on the winding 20 approaches the desired length, as shown in FIG. 3B, a ligature device 18 of known technology, equipped with two mobile arms 180, a single one being visible in the figure, is brought near to the winding 20 for finishing. The rotation of the winding station, or respectively of the winding 20, is stopped, its stop position being controlled by the angular position detector 16, described further above, in such a way that a space separating two consecutive segments 111 of the side plate 11 is located facing the two bent arms 310 and 320. The closure device 3 is unlocked relative to the frame and is locked relative to the side plate. Simultaneously, the two jacks 31 and 32 are actuated so that the two pressing portions 311 and 321 clamp the last layer of the winding 20. A rotation by a portion of a turn of the winding 20 is then ordered, driving the device by means of the locking 34 between the device 3 and the side plate or by means of the pressing portions 311 and 321 clamped against the upper layer of the winding 20 in such a way that a cutting device 19 is activated only when the length of the section of the element 2 already on the winding 20 added to the length not yet on the winding, up to the cut point, corresponds to the desired final length of the elongated element 2 on the winding 20. At this moment the rotation of the winding 20 is stopped again, the cutting device 19 is actuated, and the execution of a first ligature 181 can be ordered in order to hold the collected winding at the earliest.

This step is visible in FIG. 3B where one sees that the closure device 3 has been driven in rotation by a portion of a turn and that the cut of the end of the elongated element 2 has been made, and that a first ligature 181 has been carried out.

Figure 3C:
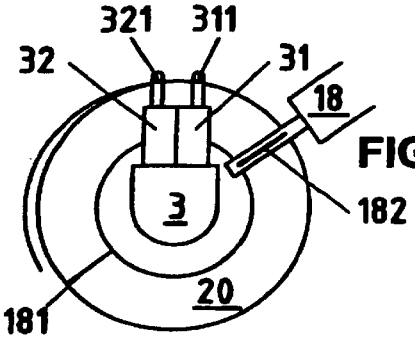

In FIG. 3C one sees that the winding 20 has been driven again in rotation by a portion of a turn, driving the closure device 3 until the latter is in position such as to be able to be locked in high position on the frame. The two pressing portions 311 and 321 still clamp the winding 20. The end of the element 2 not yet collected on the winding 20 follows freely. The ligature device makes the second ligature 182.

Figure 3D:
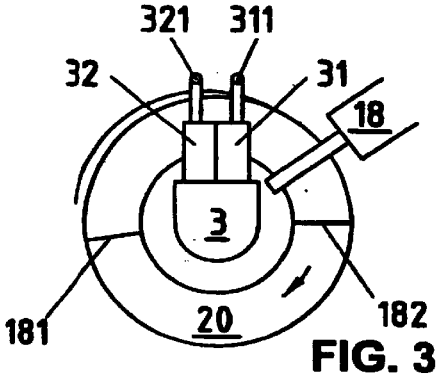

In FIG. 3D, the closure device 3 remains locked in high position relative to the frame, but is unlocked relative to the side plate. The two jacks 31 and 32 are actuated in order to release the winding 20, and the latter is driven in rotation by a portion of a turn.

Figure 3E:
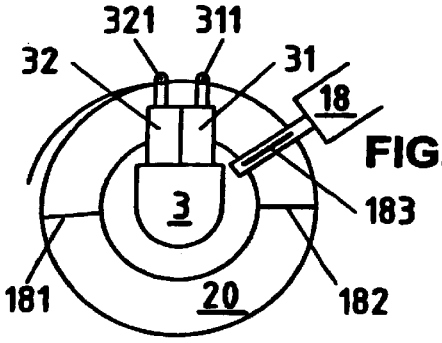

Then, as seen in FIG. 3E, the movement of rotation of the winding 20 is stopped, the two jacks 31 and 32 are actuated so that the pressing portions 311 and 321 clamp the winding 20 again, and a new ligature 183 is made.

As variant, it is also possible that upon rotation of the winding between the step of FIG. 3D and that of FIG. 3E, a slight pressure remains applied by the two pressing portions 311 and 321 on the outer layer of the winding, in such a way as to press the free end of the elongated element against the already collected wraps of the winding 20.

The two last operations described with respect to FIGS. 3D and 3E are then repeated until the free end of the element 2 is completely collected on the winding, and held by a ligature, and the desired number of ligatures are made on the winding 20 in order to hold it rigidly.

Figure 3F:
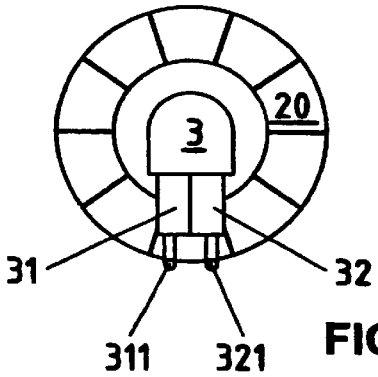

FIG. 3F shows the winding 20 completely finished, a certain number of ligatures having been achieved in order to hold it rigidly. The ligature device has been removed, and the closure device 3 has been brought back into low position where it is again locked on the frame. The two jacks 31 and 32 are activated in order to clamp the winding 20. At this stage, the second end plate 14 and the false center 15 are disengaged, by known means, from the side plate 11 and the winding 20, the winding remaining supported by the two bent support arms 310 and 320.

Figure 3G:
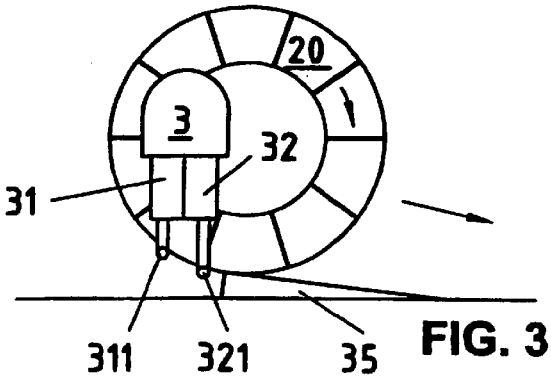

FIG. 3G shows use of the device 3 for the discharging of the winding 20. The winding is supported only by the bent support arms 310 and 320. It now suffices to lower slightly the bent support arm 320 or to raise slightly the bent support arm 310 so that the winding is out of balance and begins to pivot in order to disengage itself from the winding station. A ramp 35 and guide means, not shown, allow bringing it toward an interim storage station, from where it can be taken by known means.

The different steps mentioned above permitting closure and discharge of a winding have been mentioned only by way of possible example of a closure and discharge process. Variants are clearly also conceivable. For example, it is not absolutely necessary that the first ligature 181 be made as soon as the cut has been made of the end of the elongated element. It can also be made a little earlier, for example, during the first stop of the winding station, or a little later, the ligature 182 being then the first ligature made on the winding. Other variations of the process are also possible.

The device 3 has been described with two jacks 31 and 32, it being possible for these to be hydraulic or pneumatic jacks. Other means of actuating the bent support arms 310 and 320 can also be envisaged, for example by rack, endless screw or other mechanical means.

The device for closure and discharge of a winding has been described to be incorporated preferably into a winding station such as described in the application EP 0992447 A1. In this case, where the winding station is double, one will therefore have two devices such as described, one for each station. It is evident that such a device can be associated with winding stations having different configurations; one skilled in the art will know how to adapt the structural features and functioning described above to the winding station he has to equip.

It is likewise not absolutely necessary that the means described allowing discharge of the winding from the winding station be included in the winding closure device. In the case where the winding station has already been equipped with a device for discharge, the device described could be simplified by providing for the two jacks 31 and 32 to be able to function only simultaneously, for example, or otherwise by providing for a sole jack.

As indicated further above, the different operations described above are preferably carried out under the control of the control unit 17. Thus it is possible to completely automate the operations of finishing of the winding as well as its discharge from the winding station. Since the operator no longer has to grasp the free end of the elongated element, nor even push the finished winding to disengage it from the winding station, serious risks of danger are thus eliminated.

What is claimed is:

1. A closure device for a winding of an elongated element, each winding comprising a plurality of layers of elongated elements collected on a winding station, the winding station having at least one frame element, a bearing fixed to the at least one frame element, a spindle supported by the bearing, a side plate fixed to and supported by the spindle, a false center, and a device for making ligatures, the closure device comprising:

a support in free rotation about the spindle and at least one actuating element, fixed to the support, the at least one actuating element able to displace radially at least one bent arm having a support portion fixed in a way parallel to the axis of rotation of the support.

2. The device according to claim 1, wherein each support portion is able to take a position of clamping a last layer of the elongated element collected on the winding and a position of unclamping of the last elongated element layer collected.

3. The device according to claim 1, farther comprising two actuating elements, each being able, simultaneously or separately, to displace radially a bent support arm each bent arm support comprising a pressing portion.

4. The device according to claim 1, wherein each actuating element is made up of a jack, a piston rod of the jack actuating directly the at least one bent support arm.

5. The device according to claim 1, further comprising an angular position detector detecting the angular position of the side plate and permitting an actuation into a clamping position of the at least one actuating element only for certain predetermined angular spacings between the angular position of the side plate and that of the closure device.

6. The device according to claim 5, further comprising a first locking element able to lock the closure device in at least one predetermined angular position relative to the side plate, the angular position or positions corresponding to at least one angular position in which the at least one actuating element can be actuated in clamping.

7. The device according to claim 1, further comprising a second locking element able to lock the device in at least one predetermined angular position relative to the frame element.

8. The device according to claim 7, wherein the second locking element is able to lock the device in two angular positions offset by 180° in a vertical axis.

9. A winding station comprising:

at least one frame element:

a bearing fixed to the at least one frame element;

a spindle supported by the bearing;

a side plate fixed to and supported by the spindle and able to be set in rotation;

a device for making ligatures; and a closure device according to claim 1.

10. The device according to claim 1 wherein the winding station holds a free end of the elongated element of the winding during the making of at least one ligature on the winding.

11. The device according to claim 1, further including means allowing disengagement of at least one side plate and the false center having served the making of the winding, the closure device being able to support the finished winding using the at least one bent support arm and to actuate a single actuator of the bent support arm in such a way as to make the winding swing out of the winding station.

* * * * *